US005112243A

United States Patent [19]

Chow et al.

[11] Patent Number: 5,112,243

[45] Date of Patent: May 12, 1992

[54] LATCHING DEVICE FOR AN ELECTRICAL CONNECTOR

[75] Inventors: Hsiu-Shen Chow, Pan-Chiao, Taiwan; Leonard Ellentuch, Wallkill, N.Y.

[73] Assignees: Chian Chyun Enterprise Co. Ltd., Taipei Hsien, Taiwan; Resco, Inc., Newburgh, N.Y.

[21] Appl. No.: 657,912

[22] Filed: Feb. 20, 1991

[51] Int. Cl.[5] ..... H01R 13/627

[52] U.S. Cl. ..... 439/352; 439/358

[58] Field of Search ..... 439/345, 350-357, 439/372, 358

[56] References Cited

U.S. PATENT DOCUMENTS

| | | | |
|---|---|---|---|
| Re. 32,760 | 10/1988 | Chandler et al. | 439/610 X |
| 4,449,778 | 5/1984 | Lane | 439/610 |
| 4,501,459 | 2/1985 | Chandler et al. | 439/514 X |
| 4,601,528 | 7/1986 | Spier | 439/352 X |
| 4,711,507 | 12/1987 | Noorily | 439/347 X |
| 4,711,511 | 12/1987 | Noorily | 439/372 X |
| 4,950,179 | 8/1990 | Takenouchi et al. | 439/352 |
| 4,964,809 | 10/1990 | Jobson | 439/357 |

OTHER PUBLICATIONS

IBM Technical Bulletin, vol. 32, No. 6A, Nov. 1989.

*Primary Examiner*—Larry I. Schwartz

*Assistant Examiner*—Khiem Nguyen

*Attorney, Agent, or Firm*—Sprung Horn Kramer & Woods

[57] ABSTRACT

An electrical connector includes a housing having a plurality of contacts therein adapted to mate with contacts of another, mateable connecting device and a latching member for mechanically interlocking with the other connecting device. The latching member includes an elongate latching member having two opposite ends which is captively supported by a pivot on said housing. The pivot is located generally intermediate the two ends of the latching member such that its ends may move generally transversely of the longitudinal direction of the latching member toward and away from the housing to permit interlocking with the other connecting device. The latching member also includes a movable locking member, captively supported on said latching member, for slidable movement thereon in the longitudinal direction of the latching member between a first position and a second position. The locking member has an exposed gripping portion to permit a manual change of its position and a sliding portion, attached to the gripping portion, which is operative, when the locking member is in the first position, to prevent both ends of the latching member from being pivoted toward the housing, and operative, when the locking member is in the second position, to prevent only one end from pivoting toward the housing.

13 Claims, 2 Drawing Sheets

FIG.2
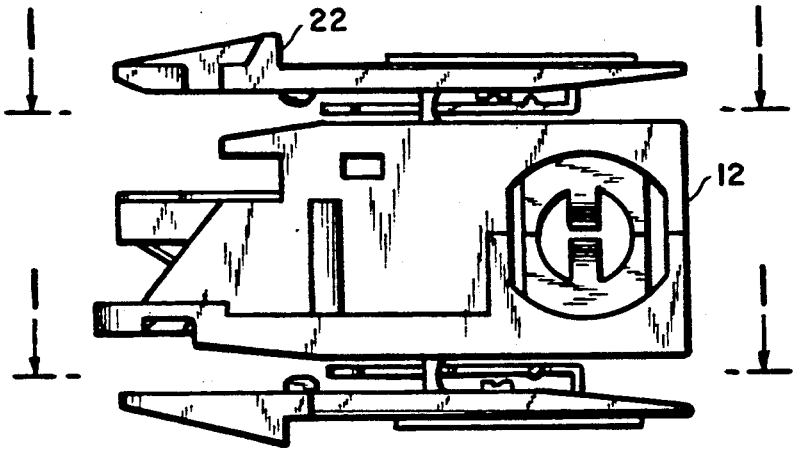
FIG.3
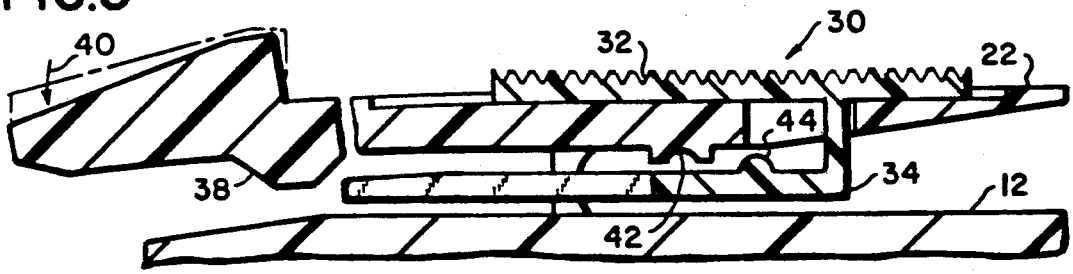
FIG.4
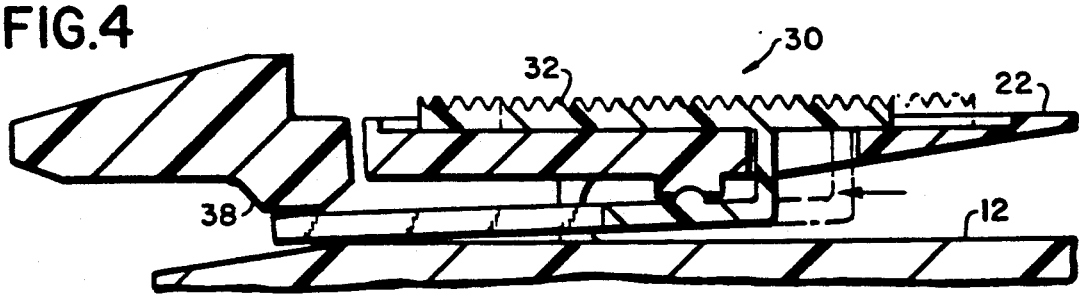
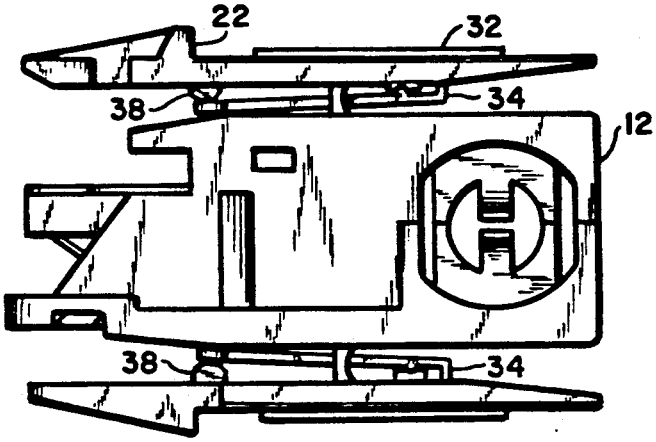
FIG.5

LATCHING DEVICE FOR AN ELECTRICAL CONNECTOR

BACKGROUND OF THE INVENTION

The present invention relates to a latching device for an electrical connector. More particularly, the invention relates to a locking device for preventing accidental disengagement of the latching device when the connector is in use.

In the use of electrical connectors there is need to provide secure mechanical and electrical engagement between the electrical connector and a mateable electrical connector or other electrical device. Various latching techniques have been devised for use with electrical connectors in an effort to provide such secure engagement. One of the requirements in providing this secure engagement is the ease with which the connectors may be both attached to and detached from other devices. To satisfy this need, latching mechanisms have been developed which have pivotally supported latching arms that interlock with each other. Latching structures of this type are shown, for example, in the U.S. Pat. No. 4,449,778 and the U.S. Pat. No. 4,501,459 (reissued as U.S. Pat. No. Re. 32,760), which disclose connectors of the electrically shielded type for particular use in the data communication industry. While the pivoted latching arms, as shown in these patents, assist in the ease of attachment and detachment, there is no positive locking structure that maintains the connector in the secured position once it is connected to another connector or some other electrical device. In an effort to compensate for this problem, a separate, external wedge is provided for subsequent attachment to the electrical connector so as to prevent the latching mechanism from separating in use.

The U.S. Pat. No. 4,711,511 discloses a locking device which overcomes the problems that naturally follow from the use of a separate, external wedge. In practice, the wedges are difficult to use and require extra space to permit their insertion from the side. Also, since they are separable from the connectors, they are easily lost or misplaced.

The latching device disclosed in the U.S. Pat. No. 4,711,511 includes a moVable locking bar captively supported on the connector housing for slidable movement between the housing and the elongate latching member. When the locking bar is moved to a first position, it prevents transverse movement of both ends of the latching member. When it is moved to a second position, it permits transverse movement of both ends of the latching member.

While it is advantageous to maintain some of the features of the disclosed latching apparatus with its attendant locking bar, it is also desirable to provide improvements thereto, with respect to both cost and ease of use.

SUMMARY OF THE INVENTION

It is an object of the present invention to provide an improved locking device for the latching apparatus of an electrical connector of the type described above.

This object, as well as other objects which will become apparent from the discussion that follows, are achieved, in accordance with the present invention, by providing a movable locking member, captively supported on the latching member, for slidable movement thereon in the longitudinal direction of the latching member between a first position and a second position. The locking member has an exposed gripping portion to permit a manual change of its position and a sliding portion, attached to the gripping portion, which is operative, when the locking member is in the first position, to prevent both ends of the latching member from being pivoted toward the housing, and operative, when the locking member is in the second position, to prevent only one end from pivoting toward the housing.

Further features and advantages of the present invention will be described hereinbelow.

The preferred embodiment of the present invention will now be described with reference to the accompanying drawings.

BRIEF DESCRIPTION OF THE DRAWINGS

FIG. 2 is a side elevational view of the electrical connector of FIG. 1, in assembled form, showing latching apparatus on top and bottom with the locking member of each latching apparatus disposed in a non-operative position.

FIG. 3 is a cross-sectional view of a portion of the latching apparatus and locking member illustrated in FIG. 2 with the locking member in the non-operative position.

FIG. 4 is a cross-sectional view, similar to that of FIG. 3, with the locking member moved to its operative position.

FIG. 5 is a side elevational view, similar to that of FIG. 2, with the locking member of each latching apparatus moved to its operative position.

DESCRIPTION OF THE PREFERRED EMBODIMENT

Figure 1:
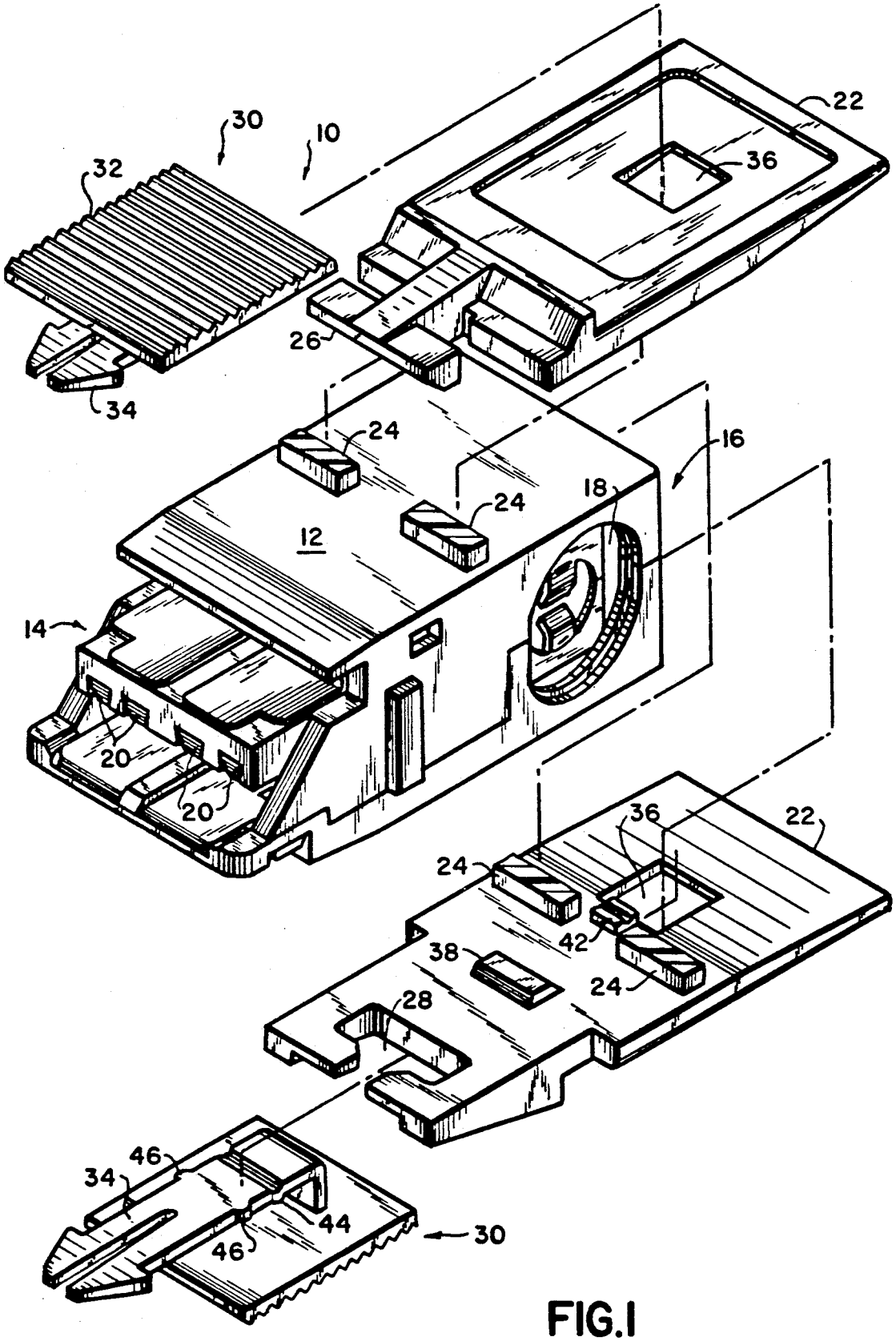
FIG. 1 is a perspective and exploded view of a shielded, hermaphroditic electrical connector embodying the improved latching and locking apparatus of the subject invention.

The preferred embodiment of the present invention will now be described with reference to FIGS. 1-5 of the drawings. Identical elements in the various figures are designated with the same reference numerals.

FIG. 1 shows an electrical connector 10 of the shielded, hermaphroditic type. A connector of this type is more particularly shown and described in the aforementioned U.S. Pat. Nos. 4,449,778 and 4,501,459. Briefly, the connector 10 comprises an insulative housing 12, a front end 14 which defines a mating end of the connector and a rear end 16 which is adapted to receive a shielded electrical cable, for example through an opening 18. The mating end of the connector 10 is provided with a plurality of electrical contacts 20 which are to be connected to the respective leads of the shielded cable.

Two elongate latching members 22 are attached to the housing 12 by means of integral pivots 24. These latching members 22 are thus designed to "rock", in seesaw fashion, on the top and bottom of the housing, respectively. As may be seen in FIG. 1, one latching member (the upper member shown in the drawing) is provided with a T-bar type latch 26 while the other member 22 (the lower member shown in FIG. 1) is provided with a T-shaped recess 28 to accommodate a T-bar type latch from another hermaphroditic electrical connector. When the mating ends 14 of two similar hermaphroditic connectors are pressed together, the T-bar of one latching member will ride over the surface of another latching member and insert itself in the T-shaped recess. To permit this latching action, the latching members must pivot slightly with respect to the housing 12; that is, the mating ends of the latching members 22 must move transversely toward or away from the housing 12.

In order to release two latched connectors, it is necessary to manually press the latching members 22 in such a way that the T-bar of one member may escape from the T-shaped recess of other. Unless the latching members 22 may be tilted or rocked in this way, they cannot be disengaged.

In order to prevent accidental or undesired disengagement of the latching members 22, each latching member is provided with a locking member 30 which will now be described in detail. Each locking member 30 comprises an exposed gripping portion 32, which permits manual change of its position on the latching member 22, and an integral sliding portion 34 having an L-shaped profile. As is illustrated in FIG. 1, the short leg of the L-shaped portion extends through an opening 36 in the latching member 22.

Referring now to FIGS. 3 and 4, it may be seen that, when the locking member 30 is moved to a first position (the left-most position which is shown in FIG. 4), it prevents movement toward the housing 12 of both ends of the latching member 22. As shown in FIG. 4, the right-hand end of the latching member 22 cannot be pressed toward the housing, at least very far, because of the limited space between the housing and the short, vertical leg of the sliding portion 34. Similarly, when the locking member is in this first position, the opposite end of the latching member 22 cannot be displaced toward the housing 12 because the free end of the sliding portion 34 of the locking member 30 is inserted between the housing 12 and at a projection 38 on the lower face side of the latching member 22.

On the other hand, when the locking member 30 is moved to a second position (the right-most position which is shown in FIG. 3) the free end of the sliding portion 34 is displaced away from the projection 38 so that, as indicated by the arrow 40 in FIG. 3, the left-hand end of the latching member 22 is free to move toward the housing. Because of the limited space between the "elbow" of the gripping portion 34 and the housing 12, the right-hand end of the latching member 22 can be moved toward the housing 12 only to a limited extent.

A detent 42 on the face side of the latching member 22 that is directed toward the housing 12 cooperates with a projection 44 on the locking member 30. This detent prevents the locking member from slipping out of its first (locked) position.

FIGS. 2 and 5 illustrate the entire connector in its unlocked and locked positions, respectively.

As is best illustrated in FIGS. 1, 3 and 4, the exposed surface of the gripping portion 32 of the locking member is provided with a plurality of ridges and grooves to nonslidably engage a person's finger when the locking member is moved between the first position and second position. Also, as illustrated in FIG. 1, the sliding portion 34 of the locking member 30 is provided with a central, longitudinal slot and two projections 46 on either side. These projections interact with the internal ends of the pivot 24 to positively hold the locking member in its first and second positions. The longitudinal slot provides resiliency to the sliding member in the transverse or lateral direction so that the projections 46 can move toward each other when they are passed through the pivot 24.

There has thus been shown and described a novel latching device for an electrical connector which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. An electrical connector comprising:

(a) a housing having a plurality of contacts therein adapted to mate with contacts of another, mateable connecting device; and (b) latching means comprising:

(1) an elongate latching member having two opposite ends and a longitudinal axis therebetween, said latching member being captively supported by a pivot on said housing, said pivot being located generally intermediate said two ends of said latching member such that said ends may move generally transversely of said longitudinal axis toward and away from said housing, one end of said latching member including a latch for mechanically interlocking with a cooperating latch of said mateable connecting device; and (2) a movable locking member, captively supported on said latching member, for slidable movement thereon in the direction of said longitudinal axis between a first position and a second position, said locking member including:

(i) an exposed gripping portion to permit a manual change of its position, and (ii) a sliding portion, attached to said gripping portion, which is operative, when said locking member is in said first position, to prevent said one end of said latching member from being pivoted toward said housing; wherein said gripping portion and said sliding portion are both integral portions of the same member; wherein said sliding portion is attached to the side of said gripping portion which faces said latching member; and wherein said sliding portion extends through an opening in said latching member.

2. The electrical connector defined in claim 1, wherein said gripping portion is disposed on the side of said latching member facing away from said housing and wherein said sliding portion is disposed between said latching member and said housing.

3. The electrical connector defined in claim 1, wherein said gripping portion is plate shaped.

4. The electrical connector defined in claim 1, wherein said sliding portion is "L" shaped in profile, with a shorter leg and a longer leg connected in substantially perpendicular relationship, and wherein the longer leg extends in the direction of said longitudinal axis.

5. The electrical connector defined in claim 4, wherein said longer leg is disposed on the surface of said housing that faces said latching member.

6. The electrical connector defined in claim 5, wherein said latching member includes a locking projection on the surface thereof that faces said housing, said longer leg of said sliding portion being disposed between said projection and said housing when said sliding portion is in said first position and being displaced away from said projection when said sliding portion is in said second position.

7. The electrical connector defined in claim 4, wherein said latching member further includes an opening therein through which the shorter leg of said L-shaped sliding portion extends.

8. The electrical connector defined in claim 1, wherein said latching member further includes detent means, cooperating with said locking member, for releasably holding said locking member in said first position.

9. The electrical connector defined in claim 1, wherein said sliding portion extends in said direction of said longitudinal axis from one side of said pivot to the other.

10. The electrical connector defined in claim 1, wherein said gripping portion has at least one ridge thereon to non-slidably engage a persons finger during a manual change of position.

11. The electrical connector defined in claim 10, wherein said gripping portion has a plurality of ridges on the side thereof facing away from said latching member.

12. The electrical connector defined in claim 1, wherein said sliding portion is operative, when said locking member is in said first position, to prevent both ends of said latching member from being pivoted toward said housing.

13. The electrical connector defined in claim 1, wherein said sliding portion is operative, when said locking member is in said second position, to prevent only one end of said latching member from being pivoted toward said housing.

* * * * *